United States Patent [19]

MacGregor

[11] Patent Number: 4,875,246

[45] Date of Patent: Oct. 24, 1989

[54] SURFACE TREATING DEVICE

[75] Inventor: Francis W. MacGregor, Simsbury, Conn.

[73] Assignee: Quad Research, Inc., Avon, Conn.

[21] Appl. No.: 223,221

[22] Filed: Jul. 22, 1988

[51] Int. Cl.[4] ..... A47L 11/29

[52] U.S. Cl. ..... 15/98; 15/50 C; 15/119 A; 335/183

[58] Field of Search ..... 15/24, 23, 49 C, 50 C, 15/52, 97 R, 98, 377, 383, 389; 310/67 R

[56] References Cited

U.S. PATENT DOCUMENTS

| | | | |
|---|---|---|---|
| 2,528,870 | 11/1950 | Detweiler | 15/49 C |
| 2,706,863 | 4/1955 | Jones | 15/98 X |
| 3,172,138 | 3/1965 | Price | 15/98 |
| 4,268,769 | 5/1981 | Dorner et al. | 15/377 |
| 4,570,278 | 2/1986 | Bloome et al. | 15/97 R |

FOREIGN PATENT DOCUMENTS

| | | | |
|---|---|---|---|
| 0118659 | 9/1979 | Japan | 15/389 |

*Primary Examiner*—Edward L. Roberts
*Attorney, Agent, or Firm*—McCormick, Paulding & Huber

[57] ABSTRACT

A portable power operated surface cleaning device comprising a handle assembly, a hollow generally cylindrical roller supported for rotation on and relative to the handle assembly, and an absorbent generally cylindrical applicator sleeve coaxially supported on said roller for rotation therewith. The roller is driven by an electrical motor contained within it and powered by a rechargeable battery also supported within the roller. Operation of the motor is controlled by a rotary electrical switch which includes a pair of magnetically responsive electrical switch contacts contained within the roller and a magnetic switch actuator mounted on the handle assembly. A reservoir assembly releasably secured to the handle assembly contains a supply of cleaning solution which is released from the reservoir assembly for gravity flow through passageways in the handle assembly and onto the applicator sleeve along a substantial portion of the axial length of the applicator sleeve in response to operation of a manually controlled valve associated with the reservoir assembly. A manually operated wringer supported on the handle assembly is movable into squeezing engagement with the applicator sleeve to expell waste liquid from the applicator sleeve which is collected and stored within a waste liquid container associated with the handle assembly.

21 Claims, 7 Drawing Sheets

SURFACE TREATING DEVICE

BACKGROUND OF THE INVENTION

This invention relates in general to surface treating devices and deals more particularly with an improved power operated device for treating a surface, as, for example, applying cleaning solution to and removing it from a surface to be cleaned or removing a spilled liquid from a source.

In cleaning a typical floor surface using a sponge mop or the like, it is conventional practice to work from a bucket or pail containing a relatively large quantity of cleaning solution, usually a mixture of water and ammonia or liquid detergent. The mop is dipped into the bucket to pick up cleaning solution and is periodically "wrung-out", usually into the same bucket. Unless two buckets are used, one for clean solution and one for collecting dirty solution, which rarely the case, dirty solution is introduced into the clean solution after the first mopping application causing the clean solution to become progressively dirtier as the operation continues. Unless the dirty solution is thrown away and replenished with clean solution several times during the mopping operation, the floor is actually being "cleaned" with dirty solution after the initial application of solution to the floor.

Cleaning devices of the aforedescribed general type are wasteful in that large quantities of cleaning solution may be prepared and handled in cleaning an average floor, although a relatively small amount of cleaning solution is actually applied to the floor during the cleaning process.

Such power operated surface scrubbing, polishing and cleaning devices as have heretofore been available have not solved the aforedescribed problem, are usually heavy and cumbersome, operate on conventional household electrical current and require a lengthy electric supply cord which must be coiled or otherwise organized for storage. Further, the use of such an electrically powered device to perform a wet surface treating or cleaning operation presents a potentially serious electrical shock hazard.

It is the general aim of the present invention to provide an improved, compact, lightweight, electrically powered surface treating device operated by a self-contained low voltage power source and having a low profile which enables the device to be moved into the kick space of a kitchen cabinet or the like when the device is moved either toward the cabinet or in a direction generally parallel to the direction of cabinet extent. A further aim of the present invention is to provide an improved power operated cleaning device which is economical to use and which carries a supply of cleaning solution which may be dispensed as required for immediate use, and which picks up and stores for later disposal dirty solution produced during the cleaning process. A still further aim of the invention is to provide a power operated device for picking up liquid spilled on a surface and storing it for disposal at a later time.

SUMMARY OF THE INVENTION

In accordance with the present invention an improved compact portable power operated surface treating device is provided which has a handle assembly and a hollow generally cylindrical roller, a motor contained within the roller, and a power supply source wholly contained within the roller for operating the motor. The roller assembly is or may be releasably secured to the handle assembly. The device may further include a novel manually operable rotary switch for electrically connecting the power supply source to the motor. The switch has electrical contacts contained within the roller and a switch actuator supported on the handle assembly for movement relative to the handle assembly and the roller to move the switch contacts from open to closed position to operate the motor.

BRIEF DESCRIPTION OF THE DRAWINGS

FIG. 2 is an exploded perspective view of the cleaning device shown in FIG. 1.

DETAILED DESCRIPTION OF PREFERRED EMBODIMENTS

Figure 1:
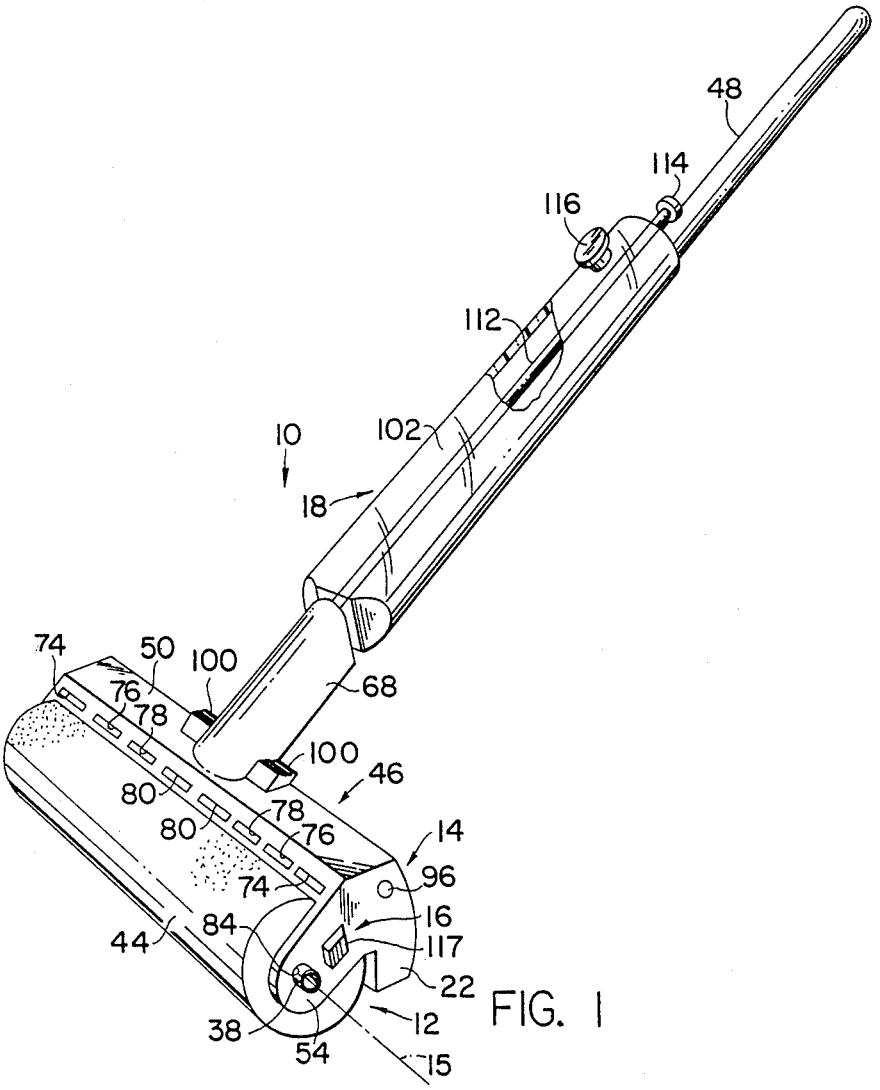
FIG. 1 is a perspective view of a surface cleaning device embodying the present invention.
Figure 7:
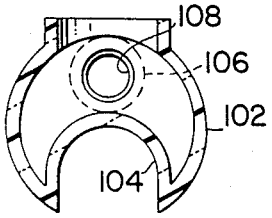
FIG. 7 is a somewhat enlarged sectional view taken along the line 7—7 of FIG. 2.
Figure 8:
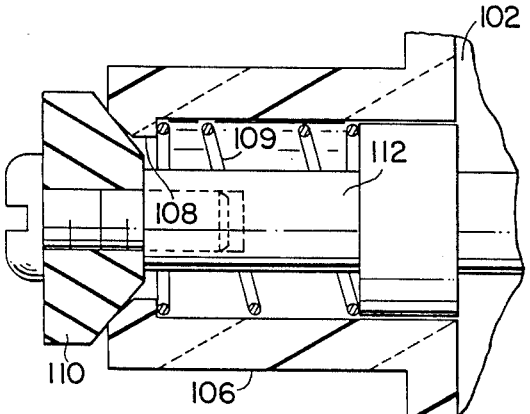
FIG. 8 is a somewhat enlarged fragmentary sectional view through the valve assembly.

A surface treating device embodying the present invention may take various forms. However, in the drawings and description which follows the invention is illustrated and described with reference to a long handled power operated surface cleaning device indicated generally by the numeral 10 in FIGS. 1 and 2. The illustrated cleaning device 10 essentially comprises a power operated roller assembly, indicated generally at 12, supported on a handle assembly, designated generally by the numeral 14, for rotation about a roller axis 15. A novel rotary magnetic switch, indicated generally at 16, controls operation of the device. The illustrated cleaning device also has a cleaning liquid reservoir assembly, indicated generally at 18, releasably connected to the handle assembly for containing and dispensing a supply of cleaning solution or the like, a wringer assembly 20 carried by the handle assembly 14 and shown in FIGS. 2, 3 and 5 and a liquid waste container 22, which comprises an integral part of the handle assembly. The wringer assembly 20 cooperates with the roller assembly 12 to remove dirty cleaning liquid from the roller assembly. The dirty liquid is collected and stored in the liquid waste container 22 for later disposal, all of which will be hereinafter more fully described.

Figure 4:
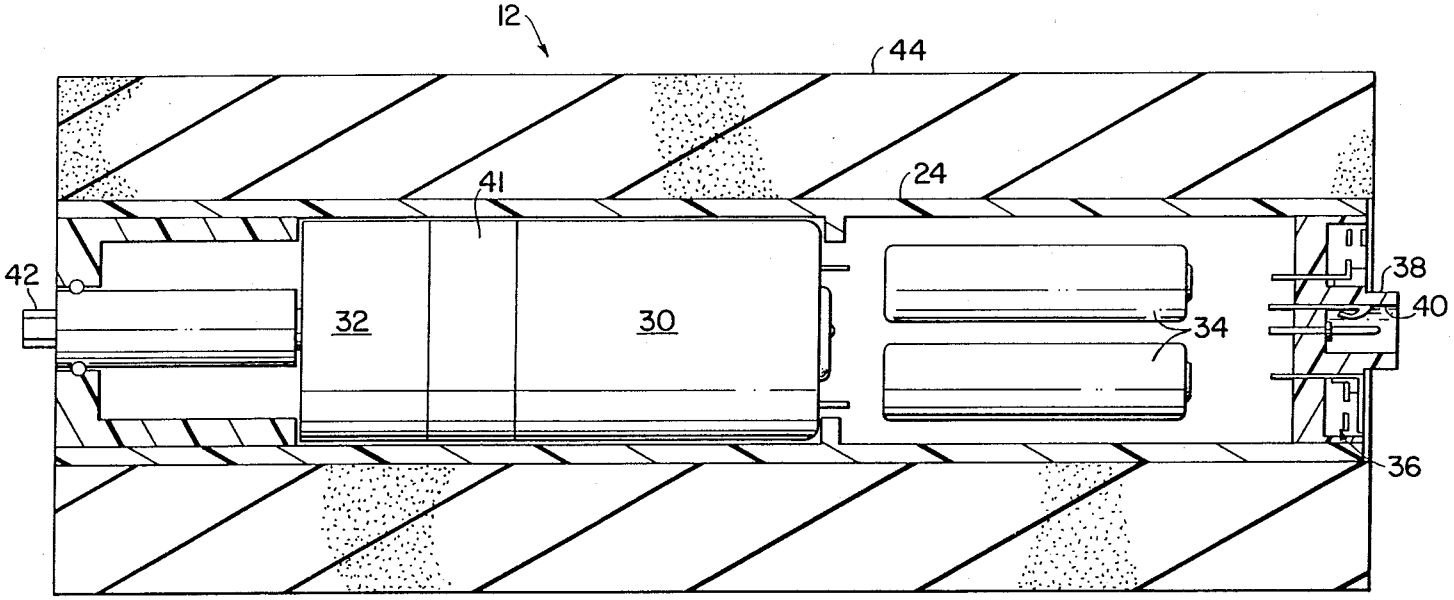
FIG. 4 is a somewhat further enlarged axial sectional view through the roller assembly.

Considering now the cleaning device 10 in further detail, the roller assembly 12, best shown in FIG. 4, includes a hollow generally cylindrical tubular roller 24, sealed at its opposite ends by end caps 26 and 28, which form end walls of the roller 24. The power operated roller assembly further includes a D.C. electric motor 30, a gear reduction unit 32, a power supply source which, as shown, comprises rechargeable batteries 34,34, a set of switch contacts indicated generally at 36, which comprise part of the rotary switch 16, and associated electrical circuitry (not shown), all of which are contained within the roller 24. The motor 30, gear reduction unit 32 and batteries 34,34 are mounted in fixed position within the roller 24 and separated by suitable spacers so that the center of gravity of the assembly is located axially centrally of the roller 24. The switch contacts 36 are sealed within the hollow end cap 28, which is formed with a coaxially outwardly projecting hollow axle 38. The hollow axle defines a recharging socket 40 containing electrical contacts and for receiving a mating electrical plug connector on a battery charging device (not shown) which operates on household electrical current. The electrical contacts are exposed within the socket 40 and are connected to the rechargeable batteries 34,34 through an associated conventional recharging circuit (not shown).

In the illustrated embodiment 10 an adapter/spacer 41 (FIG. 4) separates the motor 30 from the gear reduction unit 32 to which it is drivingly connected. The gear reduction unit 32 is preferably a planetary type and has a rotating drive or output shaft 42 supported by a suitable bearing block and seal contained within the end cap 28. The output shaft 42 has an exposed outer end portion of non-circular cross-section which is preferably hexagonal and projects coaxially outward beyond the roller end wall. An applicator 44 also comprises a part of the roller assembly. The applicator is preferably replaceable and comprises a cylindrical tubular sleeve adapted to slide onto the roller 24 and remain in fixed position relative to it. The illustrated replaceable applicator sleeve 44 is made from a relatively soft highly absorbent synthetic sponge material particularly adapted for economical manufacture.

The handle assembly 14 which supports the roller assembly 12 includes a handle frame indicated generally at 46 and an elongated handle 48 attached to the handle frame as shown in FIG. 1. The handle frame is preferably made from resilient plastic material and has a top wall 50, a pair of end walls 52 and 54, which depend from opposite ends of the top wall, and a rear wall 56, which depends from the top wall 50 and extends between the end walls 52 and 54. In the illustrated embodiment 10 the liquid waste container or trough 22 comprises an integral part of the handle frame 46, and is partially defined by the rear wall 56 and further defined by a bottom wall 58, which projects forwardly from the lower edge of the rear wall 56 and extends between the end walls 52 and 54. An upright front wall 60 projects upwardly from the forward edge of the bottom wall 58, extends between the end walls 52 and 54, and terminates at an upper edge 62 (FIG. 3) parallel to the top wall 50, spaced some distance therebelow. A portion of the handle frame which defines the trough 22 is or may be made from transparent material for a reason which will be hereinafter evident. An opening in the rear wall 56 indicated by the numeral 64 in FIG. 3 communicates with the interior of the trough 22 and is closed by a removable drain plug 66.

Figure 3:
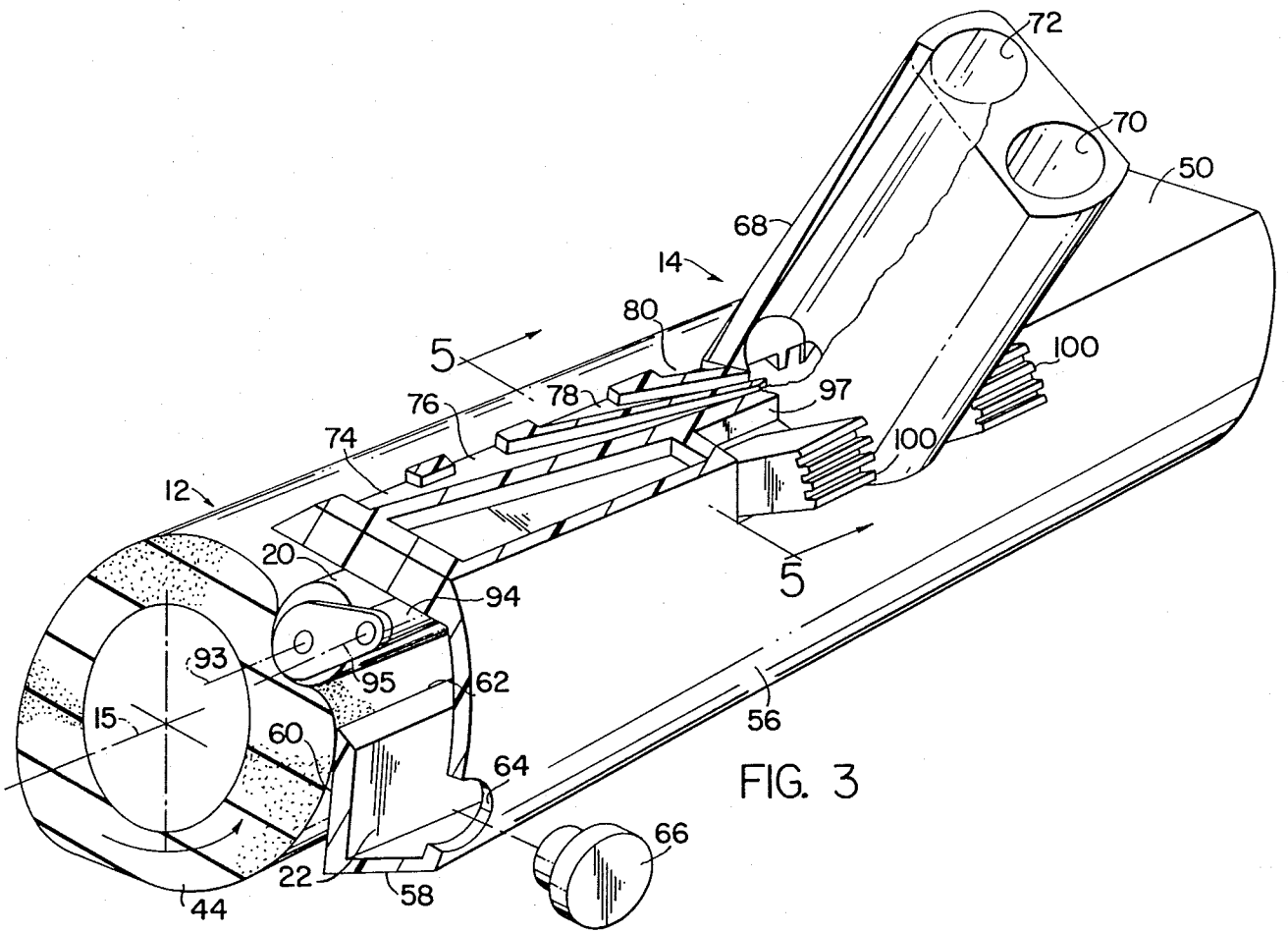
FIG. 3 is a somewhat enlarged fragmentary perspective view of the device.

The handle frame 46 further includes a connecting member 68 integrally joined to the top and rear walls 50 and 56 and inclined upwardly and rearwardly from the top wall. A blind upwardly open handle receiving socket 70 formed in the connecting member 68 is or may be internally threaded to receive and engage an associated threaded lower end portion of the handle 48. An upwardly open main fluid passageway 72, also formed in the connecting member 68 in generally parallel relation to the handle socket, communicates at its lower end with a liquid discharge manifold formed by a plurality of individual manifold passageways in the top wall. The latter passageways diverge in a forward direction from a common point of communication with the main fluid passageway 72 and terminate at manifold outlet openings or slots 74, 76, 78 and 80 which open through the forward edge of the top wall at opposite sides of the connecting member 68, as best shown in FIG. 3. The manifold passageways are constructed and arranged to simultaneously receive substantially equal quantities of liquid from the main fluid passageway 72 for a reason which will be hereinafter evident.

The roller assembly 12 is supported on the handle frame 46 between the end walls 52 and 54 for rotation about its axis 15. The end wall 52 has a non-circular drive opening 82 for receiving and complementing the non-circular extending end of the output shaft 42. A generally cylindrical journal opening 84 in the opposite end wall 54 receives and supports the axle 38 for rotation therein. The resilience of the handle frame material allows the end walls 52 and 54 to be sprung apart a sufficient distance to permit engagement of the axle 38 within the journal opening 84 after the output shaft has been inserted into the non-circular drive opening 82. When the roller assembly is assembled with the handle frame the upper edge 62 is generally tangent to the absorbent sleeve 44 and the forward edge of the top wall 50 is disposed above and in relatively close proximity to the upper peripheral surface of the sleeve.

Figure 5:
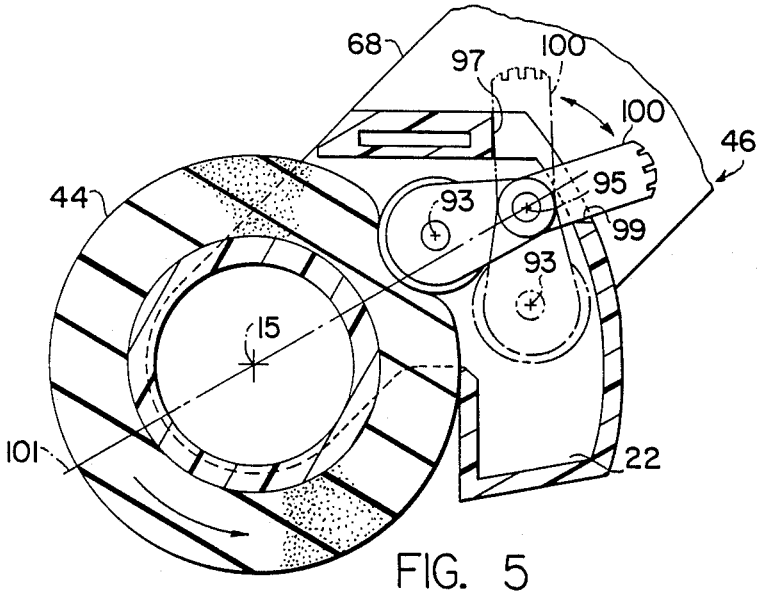
FIG. 5 is a fragmentary sectional view taken along the line 5—5 of FIG. 3.

The wringer assembly 20, as shown in FIGS. 2, 3 and 5, comprises a wringer frame 94 which supports a pair of wringer rolls 92,92 for rotation about a roll axis 93. A pair of cylindrical pivot pins 96,96 project from opposite ends of the wringer frame and are received and supported within complementary cylindrical openings 98,98 in the handle frame end walls 52 and 54, one such opening 98 being shown in FIG. 2. The cylindrical pivot pins 96,96 are radially offset relative to the roll axis 93 and support the wringer frame 94 for limited pivotal movement relative to the handle frame 46. A pair of spaced apart wringer levers 100,100 connected to a central portion of the wringer frame extend through apertures in the handle frame 46 on opposite sides of the connecting member 68, as best shown in FIGS. 3 and 5. Each of the latter apertures in the handle frame is defined by a pair of abutment surfaces 97 and 99, as best shown in FIG. 5. The wringer assembly is supported for pivotal movement about the pivot axis 95 between inactive and active positions indicated in broken and full lines, respectively, in FIG. 5. In the inactive or broken line position the rollers 92,92 are disposed immediately above the trough 22 with the roll axis 93 disposed below an axial plane 101 (FIG. 5) which contains the roller axis 15 and the wringer pivot axis 95.

When the wringer rolls 22,22 are in the inactive position, the wringer levers 100,100 are disposed in general engagement with the abutment surfaces 97,97 on the handle frame. The wringer assembly 20 is pivotally movable about the wringer frame axis 95 to its active or full line position of FIG. 5 wherein the roll axis 93 is disposed above the axial plane 101 and the wringer levers 100,100 are engaged with the abutment surfaces 99,99 on the handle frame.

The applicator sleeve 44 is supported for rotation in counterclockwise direction as viewed in FIG. 5. Consequently, light pressure applied in a rearward direction to either one or the other of the two wringer levers 100,100 when the wringer assembly is in its inactive or broken line position causes the rollers 22,22 to engage the applicator sleeve 44. The counterclockwise rotation of the applicator sleeve 44 causes a corresponding clockwise rotation of the wringer assembly 20 about the wringer frame axis 95 which moves the wringer assembly to its active or overcenter position in which it appears in full lines in FIG. 5. Further clockwise movement of the wringer assembly is prevented by engagement of the wringer levers 100,100 with the abutment surfaces 99,99 on the handle frame.

The wringer assembly 20 remains in its active position with the wringer rollers 92,92 exerting squeezing pressure upon the soft resilient applicator sleeve 44 until manually moved to its inactive position by reverse operation of one or the other of the wringer levers 100,100.

Cleaning solution is stored in the reservoir assembly 18, which is supported on and releasably secured to the handle assembly 14, as shown in FIG. 1. The illustrated reservoir assembly includes an elongated liquid storage container 102 which is preferably at least partially transparent and formed with a longitudinally extending U-shaped channel 104 for receiving an associated portion of the elongated handle 48 therein. The lower portions of the container 102 at opposite sides of the channel 104 are disposed within a common plane so that the container may be conveniently rested on any reasonably flat surface. An integral plug 106 formed on the lower end of the storage container 102, as it appears in FIG. 2, is adapted for releasable plugging connection within the upper end of the main fluid passageway 72 and has a passageway 108 therethrough for communicating with the interior of the container 102 and the main fluid passageway 72. The passageway 108 is normally maintained in closed position by a valve member 110 located at the lower end of the passageway 108 and normally biased to closed position by a valve spring 109. The valve member 110 is opened by an elongated operating rod 112 which extends upwardly through the storage container 102 and projects from the upper end thereof. A manually operated pushbutton 114 is attached to the upper end of the operating rod for moving the valve member 110 downwardly against the biasing force of the valve spring 109 and to its open position to allow gravity flow of cleaning solution from the storage container 102 into main passageway 72 to the manifold to and through the manifold slots 74,74–80,80 above th roller 24 and onto the absorbent applicator sleeve 44 along a substantial portion of the axial length of the sleeve for application to the surface to be cleaned. The manifold slots 72,72–78,78 simultaneously discharge substantially equal quantities of cleaning solution onto the applicator sleeve to provide a substantially uniform condition of wetness along the entire length of the absorbent applicator sleeve. A fill opening in the upper end portion of the storage container is fitted with an associated closure or removable plug 116.

As previously noted, the illustrated power operated roller assembly 12 is controlled by a novel rotary magnetic switch which includes the switch contacts contained within the roller 24 or more specifically sealed within the end cap 28. The switch 16 further includes a manually operable magnetic switch actuator adapted for either hand or foot operation and supported on the handle frame for movement between on and off positions corresponding to energized and de-energized conditions of the motor 30. The illustrated switch actuator 117 carries a permanent magnet 119 (FIG. 2) and is movable on the frame and in a radial direction relative to the axis of the roller assembly 12.

Figure 6:
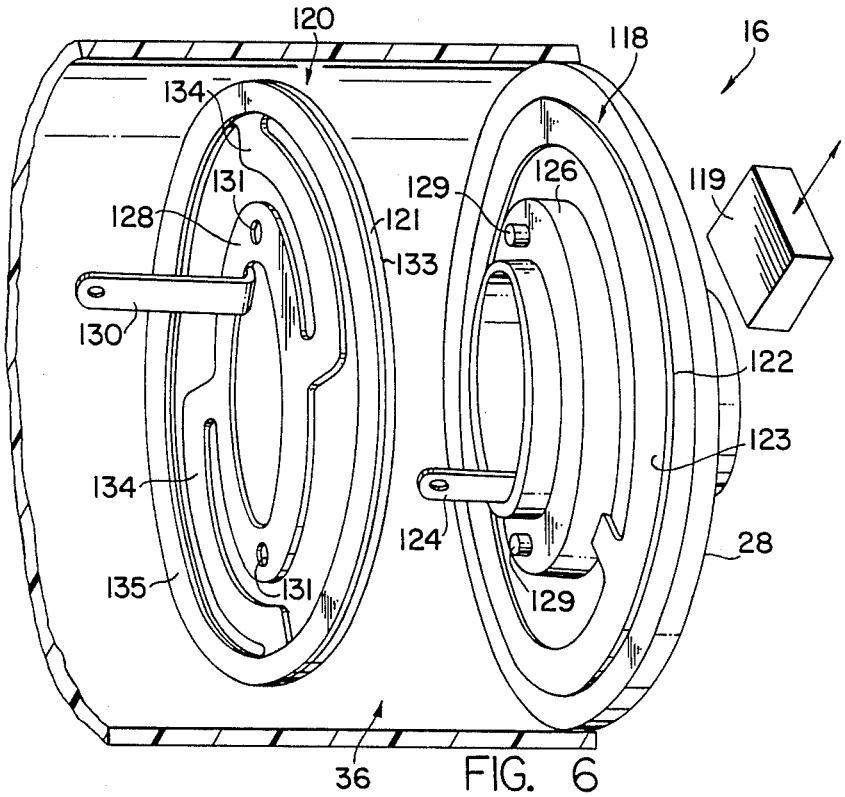
FIG. 6 is a further enlarged somewhat schematic perspective view of the rotary electric switch mechanism.
Figure 9:
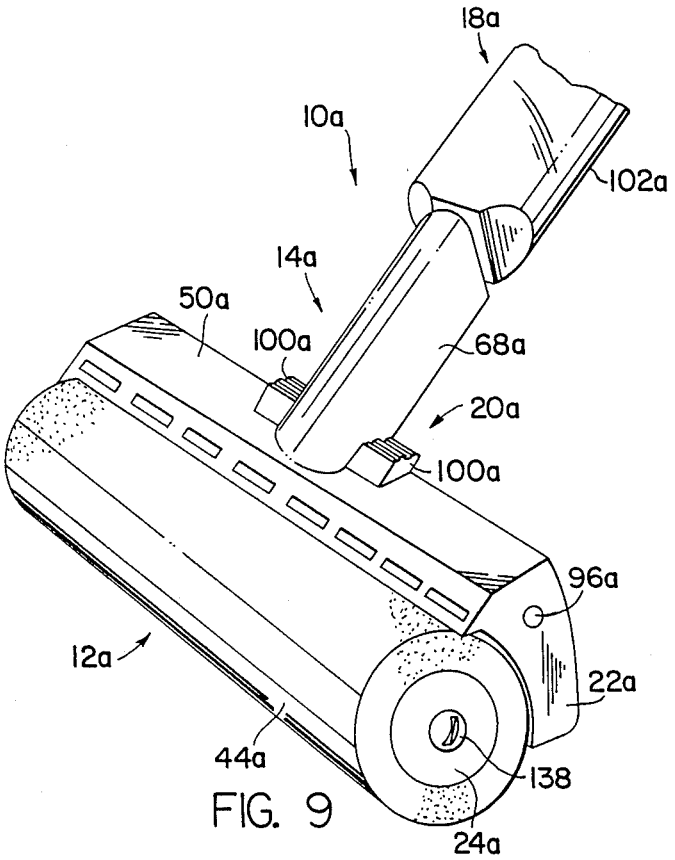
FIG. 9 is a fragmentary perspective view illustrating still another embodiment of the invention.

Considering the switch 16 in further detail and referring now particularly to FIG. 6, the contacts 36 are preferably made from a suitable resilient, flexible electrically conductive material such as phosphor bronze and include a fixed contact, indicated generally at 118, and a movable contact, designated generally by the numeral 120. At least the movable contact 120 has an annular contact portion 121 which is preferably circular.

In the illustrated embodiment the fixed contact 118 also has a circular contact portion 122, which defines an annular contact surface 123. An integral radially inwardly directed terminal portion 124 is mounted adjacent the inner surface of the end cap outer end wall and has a free end which is turned inwardly and extends in a generally axially parallel direction substantially as shown in FIG. 6.

A generally cylindrical insulator or standoff 126 made from non-magnetic electrical insulation material is supported in fixed position on the inner surface of the end cap in coaxial alignment with the fixed contact 118 for mounting the movable contact 120. The movable contact 120 has a generally circular central portion 128 for seating engagement with the standoff 126. Projecting bosses 129,129 on the standoff are engaged within complementary openings 131,131 in the central portion 128 and maintain the movable contact 120 in coaxial alignment with the fixed contact 118 restraining it against rotational movement relative to the fixed contact 118 and the roller 24. An integral terminal portion 130 projects inwardly in an axially parallel direction from the central portion 128, substantially as shown. The circular annular outer portion 121 of the movable contact defines an annular contact surface 133 substantially complementing the opposing annular contact surface 123 on the fixed contact 118. One or more spring fingers connect the inner portion 128 to the outer portion 121. However, in the presently preferred embodiment of the invention, a pair of integral arcuate spring fingers 134,134 are provided for this purpose substantially as shown in FIG. 6. Specifically, the inner ends of the spring fingers 134,134 are connected to the inner portion 128 at diametrically opposite locations whereas the outer ends of the spring fingers are connected to the outer portion 121 at diametrically opposite locations angularly spaced approximately 90 degrees from the inner end connections.

A flexible lamination of magnetic material 135 is carried by the outer portion 120 substantially as shown. The terminals 124 and 130 are sealed to and project through the end cap inner end wall (not shown in FIG. 6) and provide points of electrical connection between the power supply source and to the motor 30.

The manually operable magnetic actuator 117 is preferably supported on the handle frame end wall 54 for movement in a radial direction generally toward and away from the axis of the roller assembly 12. It will be apparent from the description which follows that the switch actuator 117 may be supported for movement in directions other than a radial direction to operate the switch 16. However, the illustrated actuator 117 is movable from an "off" position wherein the flux path of the permanent magnet 119 carried by the actuator does not significantly influence the magnetic lamination 135 to an "on" position wherein a portion of the magnetic lamination 135 in alignment with the magnet 119 comes within the magnetic influence of the magnet and is drawn toward the magnet causing an associated portion of the contact surface 133 on the movable contact 120 to engage a corresponding portion of the contact surface 123 of the fixed contact 118 to engage the motor 30. As the roller 24 rotates relative to the handle frame 14, a portion of the magnetic lamination 135 in alignment with the permanent magnet 119 is drawn toward the magnet 119 bringing a portion of the contact surface 133 into engagement with an associated portion of the contact surface 123. Thus, as the roller assembly 12 rotates relative to the handle frame 14, the annular outer portion of the flexible movable contact 120 wobbles relative to the stationary contact 118 so that continuous electrical contact is maintained between associated portions of the contact surfaces 133 and 123 aligned with the magnet 119 whereby the switch 16 remains in an electrically conductive condition to maintain the motor 30 in operation.

Preparatory to using the cleaning device 10, the storage container 102 is removed from the handle assembly for filling, as necessary. As previously noted, the container may be positioned on any substantially flat surface and may, for example, be rested on the opposing flanges of a sink in spanning relation to the sink for convenient filling. A measured quantity of liquid detergent or other suitable cleaning agent is first introduced into the storage container 102 after which water is added to fill the container which is then sealed by the plug 116 and reassembled with the device 10.

The roller assembly 12 is set into motion by moving the switch actuator 117 to its "on" position. Thereafter, a quantity of cleaning solution is fed to the roller by operating the pushbutton 114 to open the valve member 110 and allow cleaning solution to flow from the liquid storage container 102 to and through the main fluid passageway 72 and to and through the manifold slots 74–80 which uniformly distributes the solution along substantially the entire axial length of the applicator sleeve 44. Preferably, cleaning solution is periodically fed to the rotating applicator sleeve 44 to maintain a desired condition of applicator sleeve wetness as the cleaning device is moved along a surface to be cleaned.

After a portion of the surface has been cleaned, the wringer 20 is operated by applying light pressure in a rearward direction to one or the other of the wringer levers 100. Light toe pressure applied to one of the wringer levers is sufficient to cause the wringer assembly 20 to move to its over center position, as previously discussed, and exert squeezing action on the absorbent applicator sleeve 44. The wringer assembly 20 remains in its active or squeezing position until manually released by reverse operation of one or the other of the wringer levers 100,100, as hereinbefore discussed. Dirty fluid expelled from the applicator sleeve 44 by the wringer assembly collects within the liquid waste container 22.

The process of releasing clean liquid from the liquid storage container 102 to the applicator sleeve and collecting dirty liquid in the liquid waste container 22 continues until the waste container is substantially full. It will now be apparent that a portion of the handle frame which defines the trough 22 is preferably transparent so that the level of waste liquid in the trough 22 may be readily determined. Waste liquid is emptied from the waste container 22 by removing the plug 66 and tipping the device, as necessary, to allow waste liquid to flow from the opening 64.

The low profile of the handle frame 46 allows the device to be moved into the kick space of a conventional kitchen cabinet or the like to operate in this normally difficult to clean area. The rotating soft applicator 44 may be forced into the intersection formed by the cabinet kickboard and the floor. Since the applicator 44 rotates in a forward and downward direction, dirt which tends to accummulate in or near the intersection between the cabinet kickboard and the floor is drawn back out of the latter intersection by the rotating applicator and carried toward the wringer assembly 20.

The device 10 may also be employed to pick up spilled liquid by positioning the wringer assembly 20 in its active position and moving the power operated applicator sleeve 44 through the spilled liquid to pick up the liquid and deposit it in the waste liquid container 22. Thereafter the device may be operated in its cleaning mode to clean the surface contaminated by the spilled liquid.

In FIGS. 9–12 there is shown another surface cleaning device embodying the present invention and indicated generally by the reference numeral **10*a*. The device 10*a* includes a power operated roller assembly 12*a*, a frame assembly 14*a*, a cleaning liquid reservoir 18*a*, a wringer 20*a*, and a liquid waste container 22*a* and is similar in many respects to the previously described device 10. Parts of the device 10*a*** which correspond to parts previously described bear the same reference numeral and a letter "a" suffix and will not be hereinafter discussed in detail.

The cleaning device **10*a* differs from the previously described device 10 in the construction of its handle frame and the manner in which the cylindrical roller 24*a* is supported thereon. Specifically, the handle frame has an end wall 52*a* on which there is mounted an integral generally cylindrical cantilever roller support member 136 which projects from the end wall 52*a* in parallel relation to the frame top wall 50*a*. The roller 24*a* carries a resilient absorbent applicator sleeve 44*a*, as previously described, and receives the cylindrical support member 136 therein. As in the device 10, a drive motor 30*a* and an associated power supply source which includes rechargeable batteries 34*a*,34*a* are wholly contained within the roller 24*a* or more specifically within the roller support member 136 upon which the roller 24*a* is journalled. The roller support member 136 comprises a substantially sealed unit. The motor has a rotary drive member or output shaft 42*a* which includes a projecting end portion of non-circular cross-section. The latter projecting end portion is received within a complementary non-circular opening in the end wall of the roller 24*a*. A suitable fastener such as the screw indicated at 138 may be attached to the projecting end portion of the output shaft 42*a* to retain the roller 24*a*** thereon.

Figure 10:
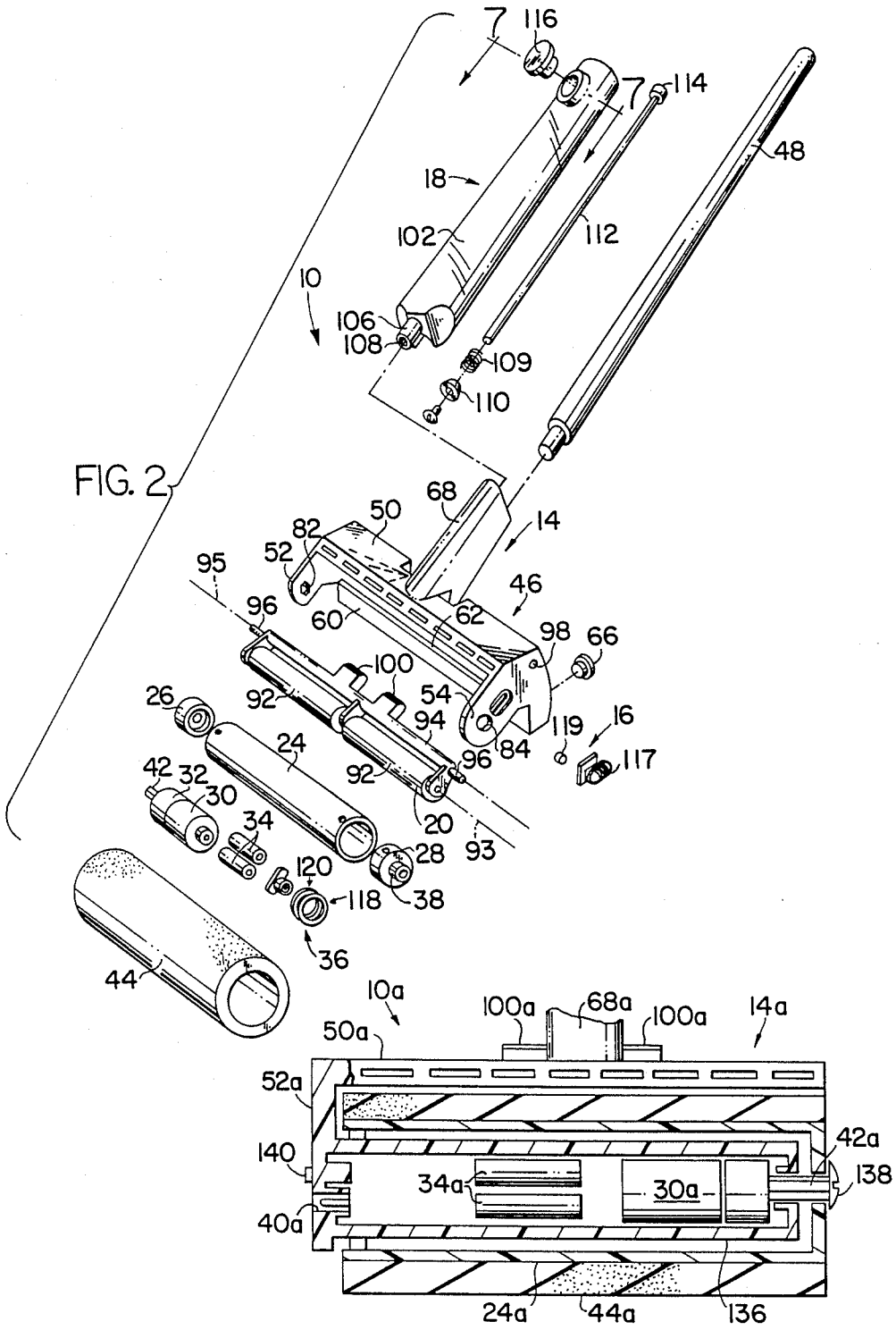
FIG. 10 is a fragmentary axial sectional view through the structure shown in FIG. 9.

A conventional electrical switch indicated at 140 is mounted on the end wall 52*a* for electrically connecting the power supply source to the drive motor 30*a*. A recharger socket 40*a* is also provided in the end wall 52*a*, substantially as shown in FIG. 10. The operation of the device 10*a* is substantially identical to the operation of the device 10, previously described.

Each of the cleaning devices hereinbefore described has a d.c. electric motor and an associated rechargeable power supply unit sealed therein. However, in some instances it may be desirable to provide a cleaning device which includes a replaceable power supply unit. An exploded axial sectional view through a roller assembly for such a device is shown in FIGS. 13 and indicated generally by the reference numeral 12*b*.

The device 12*b* includes a hollow roller 24*b* divided into two separate compartments by a central partition wall 142. One of the compartments is sealed and contains the drive motor 30*b*. The other compartment opens through the opposite end of the roller 24*b* and receives a sealed power supply unit indicated generally by the reference numeral 144 which contains rechargeable batteries 34*b*,34*b*. The illustrated sealed unit 144 also contains the switch contacts 36*b* and has an axle 38*b* which defines a recharging socket 40*b*. Electrical contacts 146,146 project from the inner end of the power supply unit 144 for contacting engagement with associated electrical contacts 148,148 connected to the drive motor 30*b* and located within another socket formed in the partition wall 142.

Figure 14:
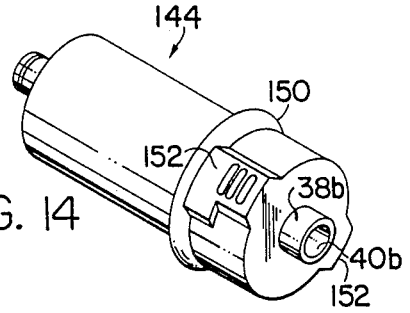
FIG. 14 is a perspective view of the power supply source shown in FIG. 13.
Figure 13:
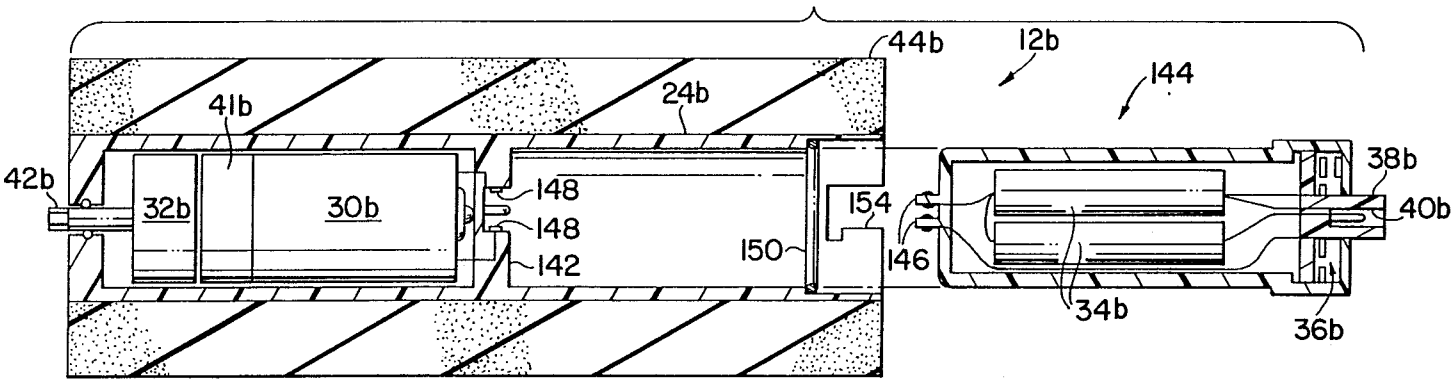
FIG. 13 is a somewhat reduced exploded axial sectional view similar to FIG. 4 but showing another roller assembly embodying the present invention.

The power supply unit 144 is sealed within the roller 24*b* by an O-ring seal 150 shown in FIGS. 13 and 14. Diametrically opposed bayonet studs 152,152 on the sealed power supply unit 144 latchingly engage bayonet slots 154,154 (one shown) formed in the end portion of the roller 24*b* to releasably secure the power supply unit 144 in sealed engagement with the roller 24*b*.

While the replaceable power supply unit hereinbefore described has been illustrated and described with reference to a roller assembly of the type used with the cleaning device 10, it should also be apparent that such a replaceable power supply unit may also be used with the cleaning device 10*a*, and such a modification of the device is contemplated within the scope of the invention.

Figure 15:
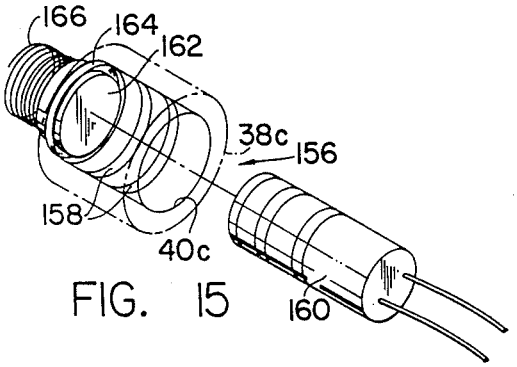
FIG. 15 is a somewhat enlarged fragmentary sectional view illustrating yet another embodiment of the invention.
Figure 12:
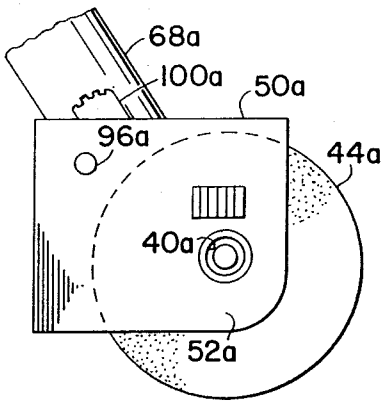
FIG. 12 is a fragmentary left end elevational view of the structure shown in FIGS. 9 and 10.
Figure 11:
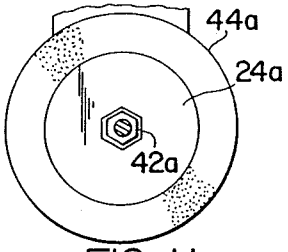
FIG. 11 is a fragmentary right end elevational view of the structure shown in FIGS. 9 and 10.

In FIG. 15 there is illustrated yet another cleaning device having a recharging socket 40*c* which includes a closure member or moisture resistant seal indicated generally at 156. In the structure shown in FIG. 15, the axle 38*c* which defines the recharging socket 40*c* is shown in phantom. Annular electrical contacts 158,158 contained within the socket 40*c* are adapted for engagement with annular contacts on a recharging plug, such as shown at 162 in FIG. 15. The closure member 156 comprises a sealing plug which carries an O-ring seal 164. A biasing spring 166 urges the sealing plug 162 toward the outer end of the socket 40*c* beyond the electrical contacts 158,158 located therein. Thus, when the recharging plug 160 is withdrawn from the socket 40*c* the sealing plug 162 is automatically biased to its sealing position by the spring 166 causing the O-ring 164 to effectively seal the socket 40*c* against entry of moisture which may cause electrical contact corrosion or contamination.

I claim:

1. A power operated surface treating device comprising a handle assembly, a generally cylindrical roller, means supporting said roller on said handle assembly for rotation about its axis and relative to said handle assembly, drive means for rotating said roller about said axis and relative to said handle assembly and including a motor supported within said roller and having a fixed part and a rotatable part, one of said parts comprising said fixed part and said rotatable part being connected to said handle assembly and the other of said parts being connected to said roller, a power supply source wholly contained within said roller, and switching means on said surface treating device for connecting said power supply source to said motor to energize said motor.

2. A power operated surface treating device as set forth in claim 1 wherein said frame assembly includes a top wall and a pair of end walls depending from opposite ends of said top wall and said means for supporting said roller comprises said end walls.

3. A power operated surface treating device as set forth in claim 2 wherein said means for supporting said roller includes an axle and said one part, said axle coaxially projecting from one end of said roller and journalled in one of said end walls, said one part coaxially projecting from the opposite end of said roller and including an end portion having a non-circular cross-section received within a complementary non-circular opening in the other of said end walls.

4. A power operated surface treating device as set forth in claim 1 wherein said roller assembly includes a generally cylindrical applicator sleeve coaxially received on said roller for rotation therewith and said device includes a reservoir assembly having a liquid storage container for holding a quantity of surface treating liquid and means for defining a liquid flow path from said container to said applicator sleeve.

5. A power operated surface treating device as set forth in claim 4 wherein said handle assembly includes a frame comprising said means for supporting said roller and said flow path defining means comprises a passageway in said frame communicating with said liquid storage container and terminating at a manifold for discharging surface treating liquid onto said applicator sleeve along a substantial portion of the axial length of said sleeve.

6. A power operated surface treating device as set forth in claim 5 wherein said handle assembly includes a handle connected to said frame and said liquid storage container is releasably supported on said handle.

7. A power operated surface treating device as set forth in claim 5 wherein said device includes means for controlling the discharge of liquid from said liquid container into said passageway.

8. A power operated surface treating device as set forth in claim 7 wherein said controlling means comprises a manually operable valve normally biased to closed position and movable to open position to release fluid from said container for gravity flow into said passageway and to and through said manifold to said applicator sleeve.

9. A power operated surface treating device as set forth in claim 5 wherein said applicator sleeve is further characterized as a resilient absorbent sleeve and said device includes means for applying squeezing pressure to said sleeve along a substantial portion of the axial length thereof.

10. A power operated surface treating device as set forth in claim 9 wherein said means for applying squeezing pressure comprises a wringer assembly supported on said frame.

11. A power operated surface treating device as set forth in claim 10 wherein said device includes a liquid waste container for receiving and storing liquid removed from said resilient absorbent sleeve by operation of said wringer.

12. A power operated surface treating device as set forth in claim 11 wherein said liquid waste container comprises an upwardly open trough defined by said frame and extending along substantial portion of the axial length of said sleeve and having an upper edge generally tangentially disposed relative to said sleeve.

13. A portable power operated surface treating device as set forth in claim 1 wherein said means for supporting said roller comprises means for releasably connecting said roller to said handle assembly.

14. A portable power operated surface treating device as set forth in claim 13 wherein said means for supporting said roller comprises an axle at one end of said roller journalled in one end of said handle assembly and a drive member comprising said one part and releasably secured in fixed position to the end of said handle assembly opposite said one end.

15. A portable power operated surface treating device as set forth in claim 1 wherein said means for supporting said roller comprises a cylindrical cantilever support member comprising said frame assembly and said roller is received and coaxially supported on said support member.

16. A portable power operated surface treating device as set forth in claim 15 wherein said drive motor and said power source are contained within said cylindrical cantilever support member.

17. A power operated surface treating device as set forth in claim 1 wherein said power supply source comprises a rechargeable battery, and said device includes a recharging circuit connected to said battery and contained within said roller, a recharging socket assembly associated with said roller and electrically connected to said recharging circuit and including means defining a socket having an end opening for receiving therein a mating connector of an associated battery charger, said socket assembly including a closure member supported within said socket for movement from a closed position wherein said closure member provides a substantial closure for said end opening to and an open position in response to insertion of a mating connector into said socket, and means normally biasing said closure member to its closed position.

18. A power operated surface treating device as set forth in claim 1 wherein said switching means includes a pair of electrical contacts mounted in axial spaced apart relation to each other within said roller for coaxial rotation in unison with said roller, said switch contacts having coaxially arranged annular portions defining opposing contact surfaces, at least one of said annular portions being flexible, means supporting said one annular portion for flexure generally toward and away from the other of said annular portions, a magnetic actuator mounted on said handle assembly for movement between a first and second position, and magnetic means associated with said one annular portion for cooperating with said magnetic actuator in said second position to move successive contiguous portions of the contact surface of said one annular portion into electrically contacting engagement with the opposing contact surface on the other of said contact portions as said roller rotates relative to said frame whereby to maintain portions of said contact surfaces in the region of said switch actuator in electrically contacting engagement with each other as said roller rotates relative to said handle assembly with said switch actuator in said second position.

19. A portable power operated surface treating device comprising a roller assembly including a hollow generally cylindrical roller sealed at its opposite ends, an electrically operated motor contained within said roller, an electrical power supply source contained within said roller for operating said motor, a coaxial output member exposed at one end of said roller and drivingly connected to said motor for rotation relative to said roller in response to operation of said motor, a pair of electrical switch contacts wholly contained within said roller and electrically connected to said motor and said power supply source for controlling the operation of said motor, an applicator sleeve received on and coaxially surrounding said roller, a handle assembly, means for releasably retaining said roller assembly in connected relation to said handle assembly with said output member in fixed position relative to said handle assembly, said roller being rotatable relative to said handle in response to the operation of said motor, and switch actuating means mounted on said handle assembly for operating said electrical contacts to control the operation of said motor.

20. A portable power operated surface treating device as set forth in claim 19 wherein said electrical switch contacts are further characterized as magnetically responsive contacts and said switch actuating means comprises a magnet mounted on said handle assembly for movement relative thereto.

21. A power operated surface treating device comprising a handle assembly including a frame and a handle projecting from said frame, a roller assembly including a hollow generally cylindrical roller and a generally cylindrical absorbent applicator sleeve coaxially received on said roller, means for supporting said roller assembly on said frame for coaxial rotation relative to said frame, a drive motor contained within said roller, a power supply source contained within said roller for operating said drive motor to rotate said roller about its axis and relative to said frame, fluid passageway means defined by said frame for discharging liquid above and onto said absorbent sleeve along a substantial portion of the axial length of said sleeve, a fluid reservoir assembly releasably secured to said handle assembly in fluid communication with said fluid passageway means for containing a quantity of treating liquid, and manually operable valve means for releasing treating liquid from said reservoir assembly into said fluid passageway means.

* * * * *